US012692784B2

(12) United States Patent
Rayssiguier

(10) Patent No.: US 12,692,784 B2
(45) Date of Patent: Jul. 28, 2026

(54) WELLBORE SEAL

(71) Applicant: Schlumberger Technology Corporation, Sugar Land, TX (US)

(72) Inventor: Christophe Rayssiguier, Melun (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/026,753

(22) Filed: Jan. 17, 2025

(65) Prior Publication Data

US 2026/0210235 A1 Jul. 23, 2026

(51) Int. Cl.

| | |
|---|---|
| ***E21B 47/117*** | (2012.01) |
| ***E21B 33/12*** | (2006.01) |
| ***E21B 47/14*** | (2006.01) |

(52) U.S. Cl.

CPC ..... *E21B 47/117* (2020.05); *E21B 33/12* (2013.01); *E21B 47/14* (2013.01)

(58) Field of Classification Search

CPC .... E21B 33/12; E21B 33/1208; E21B 33/124; E21B 47/117; E21B 47/14

See application file for complete search history.

(56) References Cited

U.S. PATENT DOCUMENTS

| | | | | |
|---|---|---|---|---|
| 9,708,882 | B2 | 7/2017 | Carragher | |
| 2002/0157828 | A1* | 10/2002 | King | E21B 47/01 166/250.14 |
| 2017/0016293 | A1* | 1/2017 | Thomas | E21B 23/01 |
| 2023/0287756 | A1* | 9/2023 | Carragher | E21B 36/00 |
| 2024/0287895 | A1* | 8/2024 | Groves | E21B 47/16 |
| 2024/0309757 | A1* | 9/2024 | Mason | H04Q 9/00 |

* cited by examiner

*Primary Examiner* — Kristyn A Hall
(74) *Attorney, Agent, or Firm* — Jeffrey D. Frantz

(57) ABSTRACT

A wellbore seal includes a eutectic plug and a gauge assembly. The eutectic plug is configured to sealably engage a casing or a formation. The gauge assembly is connected to a lower side of the eutectic plug. The gauge assembly includes a pressure gauge configured to measure a pressure of a fluid, and an acoustic transceiver in communication with the pressure gauge and configured to transmit an acoustic signal based on the pressure through the eutectic plug.

15 Claims, 5 Drawing Sheets

WELLBORE SEAL

CROSS-REFERENCES TO RELATED APPLICATIONS

None.

BACKGROUND

Before abandoning a well (such as an oil or gas well) that is at the end of its useful life, the well may be plugged with a seal to ensure that well products, such as hydrocarbons, cannot escape the well. Once the well is plugged, the strength of the seal is initially measured and may be periodically inspected.

SUMMARY

In one independent aspect a wellbore seal includes a eutectic plug and a gauge assembly. The eutectic plug is configured to sealably engage a casing or a solid formation behind a casing (in this case part of the casing is removed). The gauge assembly is connected to a lower side of the eutectic plug. The gauge assembly includes a pressure gauge configured to measure a pressure of a fluid, and an acoustic transceiver in communication with the pressure gauge and configured to transmit an acoustic signal based on the pressure through the eutectic plug.

In some embodiments, the eutectic plug is formed of a bismuth alloy.

In some embodiments, the bismuth alloy includes tin.

In some embodiments, the gauge assembly includes a battery pack and an electronic module configured to manage power consumption of the battery pack.

In some embodiments, the electronic module selectively enters into a hibernation phase to conserve battery power.

In some embodiments, the gauge assembly includes an electronic module configured to control the acoustic transceiver.

In some embodiments, the electronic module generates electronic instructions based on pressure data from the pressure gauge.

In some embodiments, the acoustic transceiver produces the acoustic signal based on the electronic instructions.

In some embodiments, the gauge assembly is connected to the lower side via an adaptor.

In some embodiments, the gauge assembly is a first gauge assembly and further comprising a second gauge assembly positioned at an upper side of the eutectic plug.

In some embodiments, the second gauge assembly receives a command via one or more of an acoustic signal and a wireline cable.

In some embodiments, the first gauge assembly and the second gauge assembly communicate with one another through the eutectic plug acoustically.

In some embodiments, the fluid is a first fluid, the pressure is a first pressure, and the second gauge assembly measures a second pressure of a second fluid.

In some embodiments, the eutectic plug is configured to sealably isolate the first fluid from the second fluid.

In some embodiments, the second gauge assembly is lowered to the eutectic plug via a wireline cable after the eutectic plug is installed.

In some embodiments, the gauge assembly extends downwardly from the eutectic plug into the fluid.

Some embodiments provide a wellbore monitoring system that includes a casing, a eutectic plug, gauge assembly, and an acoustic transponder. The eutectic plug is sealably engaged with the casing. The gauge assembly is connected to a lower side of the eutectic plug. The gauge assembly includes a pressure gauge configured to measure a pressure of a fluid, and an acoustic transceiver in communication with the pressure gauge and configured to transmit an acoustic signal based on the pressure through the eutectic plug. The acoustic transponder is mounted to the casing and configured to relay the acoustic signal.

In some embodiments, the wellbore monitoring system also includes an acoustic repeater between the gauge assembly and the acoustic transponder and configured to relay the acoustic signal between the gauge assembly and the acoustic transponder.

In some embodiments, the gauge assembly is a first gauge assembly and further comprising a second gauge assembly positioned at an upper side of the eutectic plug.

Some embodiments provide a method for monitoring a wellbore that includes sending a wake up signal acoustically to a first gauge assembly and a second gauge assembly, the first gauge assembly and the second gauge assembly being fluidly isolated from one another; receiving pressure data acoustically from the first gauge assembly and the second gauge assembly; and determining a pressure differential based on the pressure data.

In some embodiments, the method also includes sending a hibernate signal acoustically to a first gauge assembly and a second gauge assembly.

BRIEF DESCRIPTION OF THE DRAWINGS

The accompanying drawings, which are incorporated in and form a part of this specification, illustrate embodiments of the disclosure and, together with the description, serve to explain the principles of embodiments of the disclosure.

DETAILED DESCRIPTION

Figure 1:
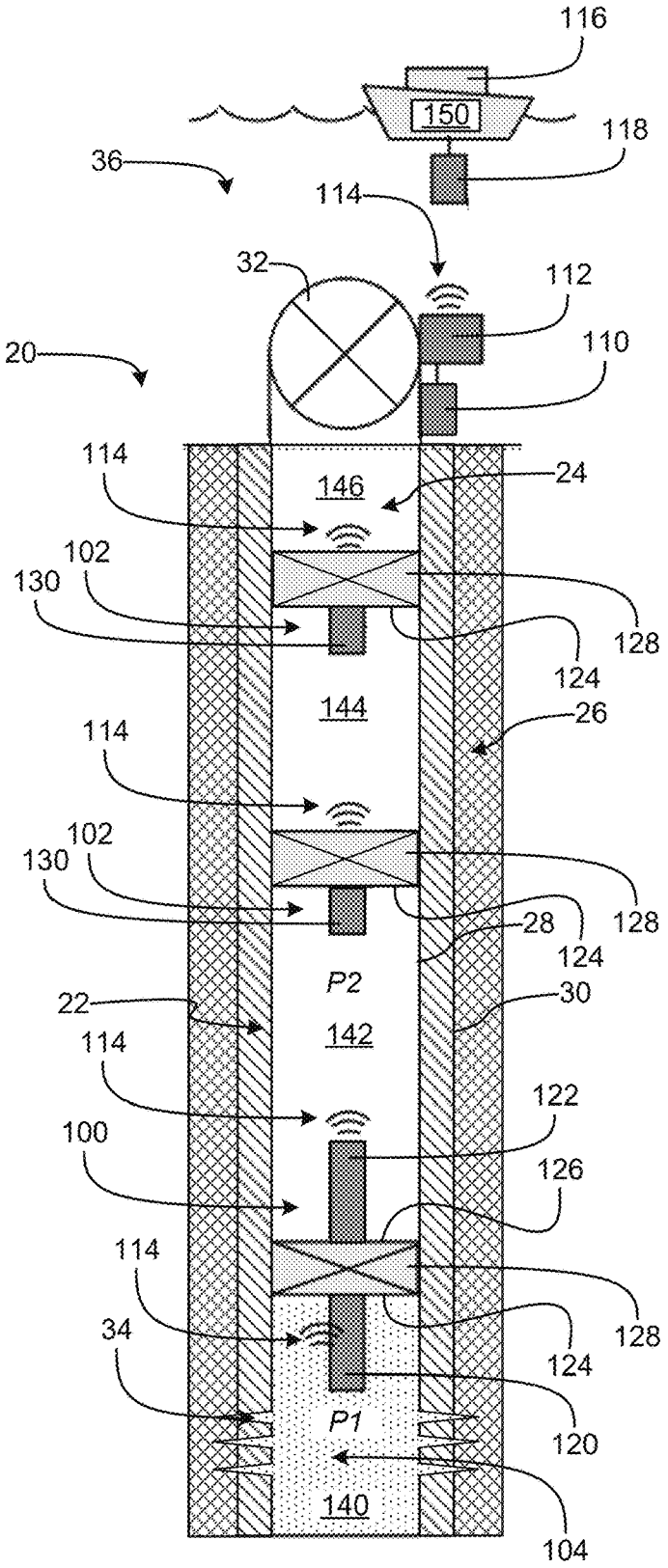
FIG. 1 is a cross-sectional view of a well system, according to an embodiment.

Various modifications to the illustrated embodiments will be readily apparent to those skilled in the art, and the generic principles herein can be applied to other embodiments and applications. Thus, it is to be understood that the disclosure is not limited in its application to the details of the configuration and arrangement of components set forth in the following description or illustrated in the accompanying drawings. The disclosure is capable of being practiced or of being carried out in various ways and is to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the disclosure. Skilled artisans will recognize the examples provided herein have many useful alternatives and fall within the scope of the disclosure.

Before any embodiments are explained in detail, it is to be understood that the disclosure is not limited in its application to the details of construction and the arrangement of components set forth in the following description or illustrated in the attached drawings. The disclosure is capable of other embodiments and of being practiced or of being carried out in various ways. Also, it is to be understood that the phraseology and terminology used herein are for the purpose of description and should not be regarded as limiting. For example, the use of "including," "comprising," or "having" and variations thereof herein is meant to encompass the items listed thereafter and equivalents thereof as well as additional items.

As used herein, unless otherwise specified or limited, the terms "mounted," "connected," "supported," and "coupled" and variations thereof are used broadly and encompass both direct and indirect mountings, connections, supports, and couplings. Further, unless otherwise specified or limited, "connected" and "coupled" are not restricted to physical or mechanical connections or couplings.

As used herein, unless otherwise specified or limited, "at least one of A, B, and C," and similar other phrases, are meant to indicate A, or B, or C, or any combination of A, B, and/or C. As such, this phrase, and similar other phrases can include single or multiple instances of A, B, and/or C, and, in the case that any of A, B, and/or C indicates a category of elements, single or multiple instances of any of the elements of the categories A, B, and/or C.

As mentioned above, current devices and methods to measure and inspect wellbore plugs are inadequate and inefficient. Thus, it would be useful to provide more sophisticated and versatile devices and methods to determine whether an abandoned well is and remains properly sealed.

Referring generally to FIG. 1, a first example well system 20 is illustrated. By way of example, a casing 22 may be disposed along a wellbore 24 drilled into a subterranean formation 26. In some well applications, the well casing 22 is metallic. The casing 22 has an interior surface 28, an exterior surface 30. Additionally, the casing 22 includes a wellhead 32 and defines perforations 34. In some instances, the well system 20 is located below water 36 (e.g., seawater). The well system 20 further includes a measurement plug assembly 100 and one or more repeater plug assemblies 102 sealably engaged with the casing 22 and/or the wellbore 24. In some embodiments, the measurement plug assembly 100 and the repeater plug assemblies 102 are substantially circular in cross-section. In operation, the measurement plug assembly 100 and the repeater plug assemblies 102 seal the wellbore 24 to prevent pressurized hydrocarbons 104 (e.g., oil, gas, etc.) from traveling through the perforations 34 and upward through the casing 22.

Remaining with FIG. 1, the well system 20 further includes a first acoustic receiver 110 and an acoustic transponder 112, which, in some embodiments, are mounted to the wellhead 32. Further in operation, the measurement plug assembly 100, the repeater plug assemblies 102, the first acoustic receiver 110, and the acoustic transponder 112 work together to send acoustic signals 114 from the wellbore 24 through the water 36 to a boat 116 equipped with a second acoustic receiver 118. More specifically, in the illustrated embodiment the measurement plug assembly 100 includes a first gauge assembly 120 positioned at and/or coupled to a side facing a direction oriented into the well (e.g., a lower side 124), and a second gauge assembly 122 positioned at and/or coupled to a side facing in a direction toward an opening of the well (e.g., an upper side 126) of a eutectic plug 128. It should be understood that the first gauge assembly 120 and the second gauge assembly 122 are substantially identical. Further, each repeater plug assembly 102 includes an acoustic repeater 130 mounted to the lower side of the eutectic plug 128. The eutectic plug 128 may be formed of a bismuth-containing alloy (e.g., bismuth alloyed with tin) deposited in the wellbore 24 in a molten state against the casing 22 using a releasable heater (not shown).

Looking again at FIG. 1, the measurement plug assembly 100, the casing 22, and the subterranean formation 26 define a primary chamber 140. Similarly, the measurement plug assembly 100, the casing 22, and one of the repeater plug assemblies 102 define a secondary chamber 142. Further, the repeater plug assemblies 102 and the casing 22 define one or more intermediate chambers 144. The wellhead 32 and one of repeat plug assemblies 102 define a terminal chamber 146.

With further reference to FIG. 1, in operation, the first gauge assembly 120 measures a first pressure P1 of the hydrocarbons 104 trapped in the primary chamber 140 by the eutectic plug 128 of the measurement plug assembly 100. Similarly, in operation, the second gauge assembly 122 measures a second pressure P2 of fluid (e.g., air, seawater, etc.) trapped in the secondary chamber 142 by the eutectic plugs 128 of the measurement plug assembly 100 and the neighboring repeater plug assembly 102. Acoustic signals 114 from the first gauge assembly 120 travel through the eutectic plug 128 of the measurement plug assembly 100 and are received by the second gauge assembly 122 and/or the neighboring acoustic repeater 130. Similarly, acoustic signals 114 from the second gauge assembly 122 are received by the neighboring acoustic repeater 130. The acoustic repeaters 130 successively receive and retransmit the acoustic signals 114 through the eutectic plugs 128 and up the wellbore 24 to the first acoustic receiver 110, which is in acoustic and/or electronic communication with the acoustic transponder 112. The acoustic transponder 112 sends the acoustic signals 114 through the water 36 to the second acoustic receiver 118, which is in acoustic and/or electronic communication with the boat 116. On board the boat 116, a controller 150 determines a pressure differential between the first pressure P1 and the second pressure P2. A net pressure differential, where the first pressure P1 is unequal (e.g., higher or lower) to the second pressure P2, indicates that the measurement plug assembly 100 is well sealed against the casing 22 and no hydrocarbons 104 have leaked past the measurement plug assembly 100 into the secondary chamber 142. A zero pressure differential, where the first pressure P1 is equal to the second pressure P2, indicates that hydrocarbons 104 have leaked past the measurement plug assembly 100 into the secondary chamber 142.

Figure 2:
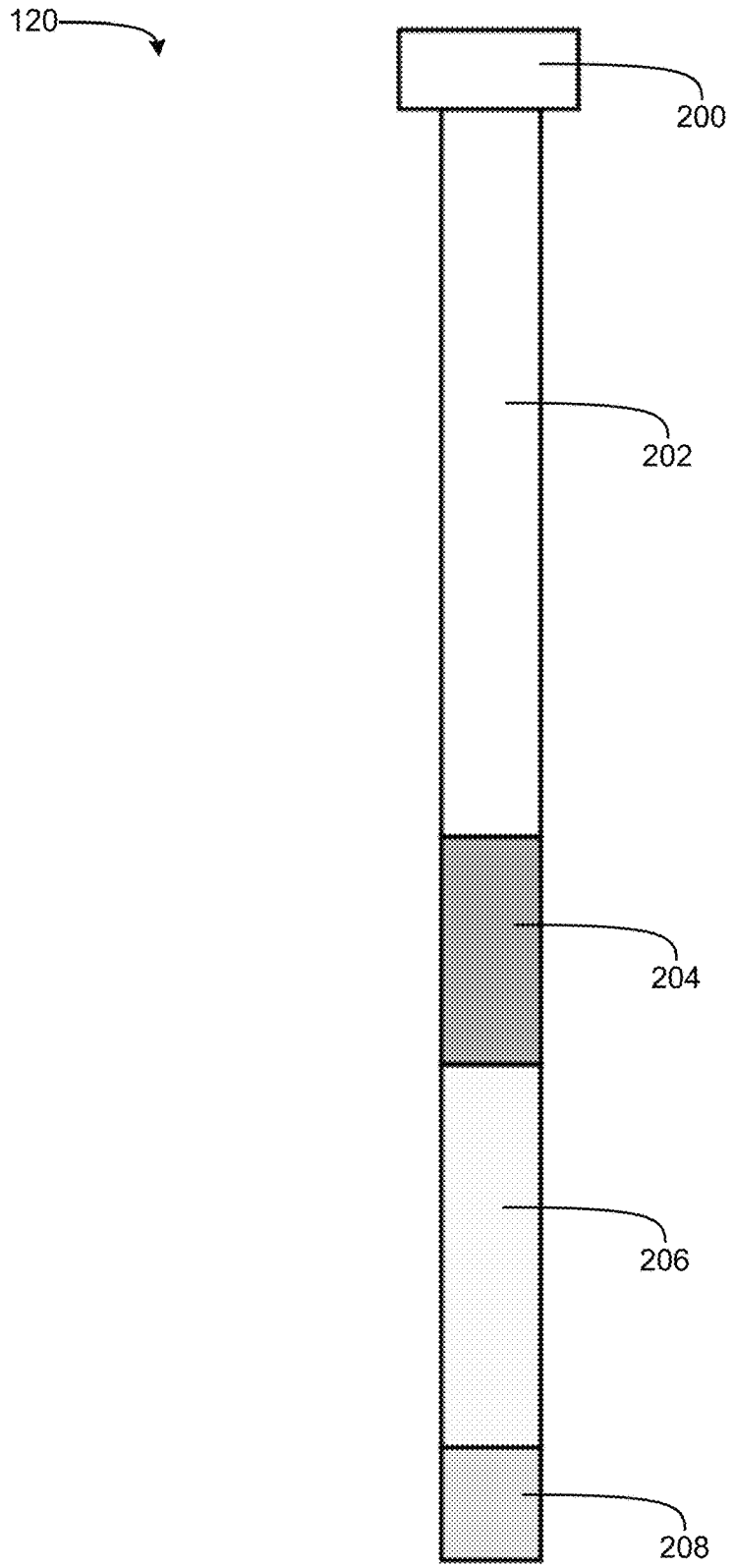
FIG. 2 is a schematic view of a gauge assembly of the well system of FIG. 1.

Turning to FIG. 2, the first gauge assembly 120 includes an adapter 200, a battery pack 202, an acoustic transceiver 204, an electronic module 206, and a pressure gauge 208. In some embodiments, the battery pack 202 is between the adapter 200 and the acoustic transceiver 204. The electronic module 206 is between the acoustic transceiver 204 and the pressure gauge 208. The battery pack 202, the acoustic transceiver 204, the electronic module 206, and the pressure gauge 208 are in electrical and/or acoustic communication with one another. It should be understood that the battery pack 202, the acoustic transceiver 204, the electronic module 206, and the pressure gauge 208 may be arranged in various alternative configurations in addition to the configuration depicted in the illustrated example of FIG. 2.

Remaining with FIG. 2, the adapter 200 physically connects the first gauge assembly 120 to the eutectic plug 128 of FIG. 1. Further, the acoustic transceiver 204 is bi-directional. More specifically, the acoustic transceiver 204 emits the acoustic signals 114 of FIG. 1 and also listens and/or receives the acoustic signals 114. Thus, the acoustic transceiver 204 may repeat and/or produce the acoustic signals 114. In some embodiments, the battery pack 202 is larger than one or more of the acoustic transceiver 204, the electronic module 206, and the pressure gauge 208. Further, the electronic module 206 includes electronic instructions to enter into and/or place itself in hibernation phases. Thus, the electronic module 206 controls, monitors, and/or manages power consumption of the battery pack 202. Consequently, the battery pack 202 lifetime is anticipated to last for several years. The pressure gauge 208 is configured to measure a pressure a surrounding fluid. The electronic module 206 generates electronic instructions based on pressure data from the pressure gauge 208 for the acoustic transceiver 204 to produce the acoustic signal 114. Overall, the first gauge assembly 120 is configured to operate in high pressure environments while submerged in various environments (e.g., hydrocarbons, petrochemicals, seawater, etc.).

Figure 3:
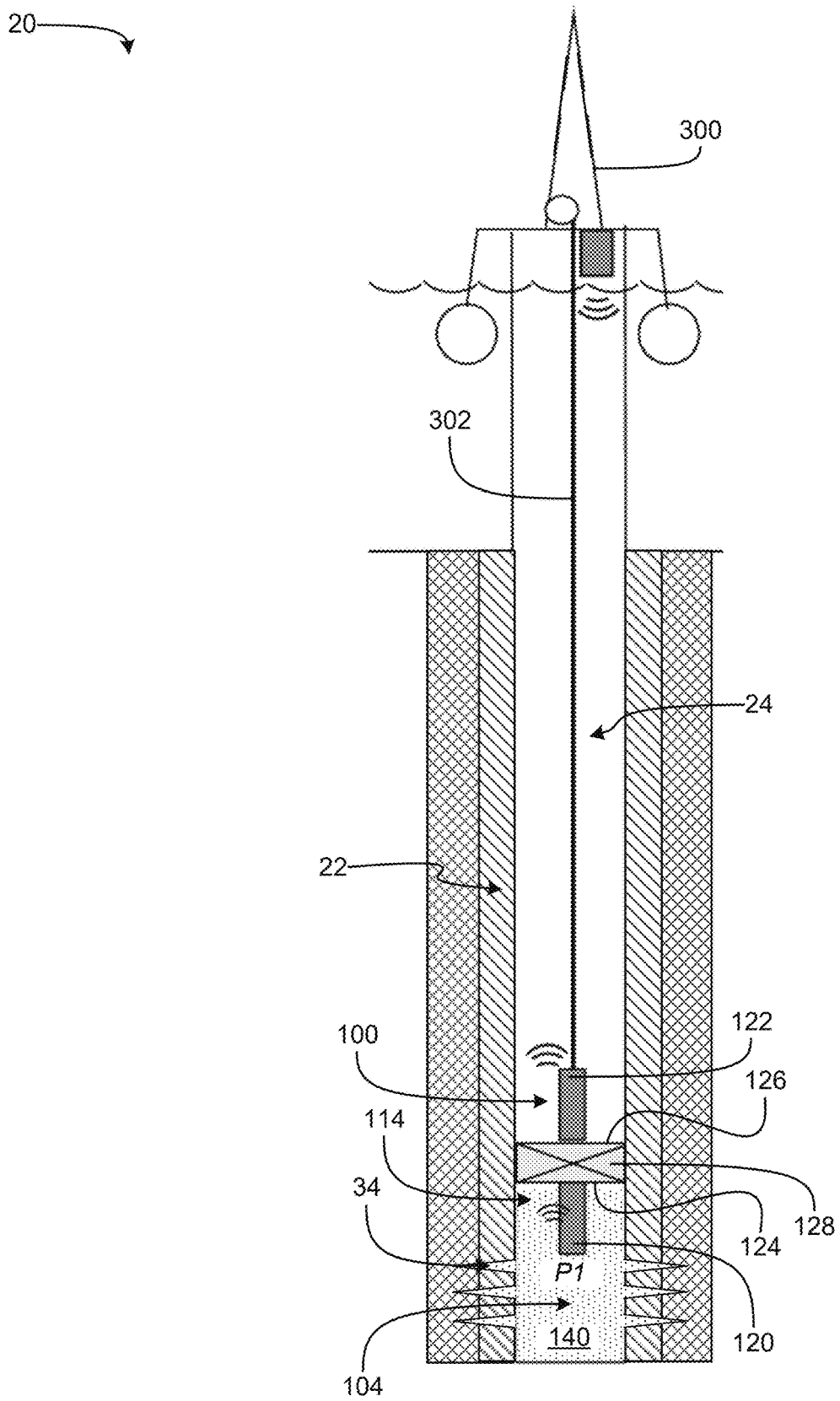
FIG. 3 is a cross-sectional view of the gauge assembly of FIG. 2 being installed in a wellbore of the well system of FIG. 1.

With reference to FIG. 3, in operation, to install the measurement plug assembly 100, a platform 300 lowers the first gauge assembly 120, a plug body (not shown), and the second gauge assembly 122 into the wellbore 24 via a wireline cable 302. Once the first gauge assembly 120 reaches a desired depth (e.g., contacting the hydrocarbons 104), the platform 300 electrically melts the plug body via the wireline cable 302. The plug body melts to sealably engage the casing 22 and form the eutectic plug 128 with the first gauge assembly 120 at and/or on the lower side 124 and the second gauge assembly 122 at and/or on the upper side 126. In some instances, the second gauge assembly 122 is lowered into the wellbore 24 via the wireline cable 302 after the eutectic plug 128 is formed and installed in the casing 22. The first gauge assembly 120 may then send the acoustic signal 114 through the eutectic plug 128 indicating the first pressure P1 of the hydrocarbons in the primary chamber 140 to the second gauge assembly 122. The second gauge assembly 122 may relay the first pressure P1 measurement to the platform 300 via acoustic signals and/or the wireline cable 302. Further, the second gauge assembly 122 may receive commands from the platform 300 via acoustic signals and/or the wireline cable 302. Thus, the platform 300 may test and verify functionality of the first gauge assembly 120, the second gauge assembly 122, and the eutectic plug 128.

Figure 4:
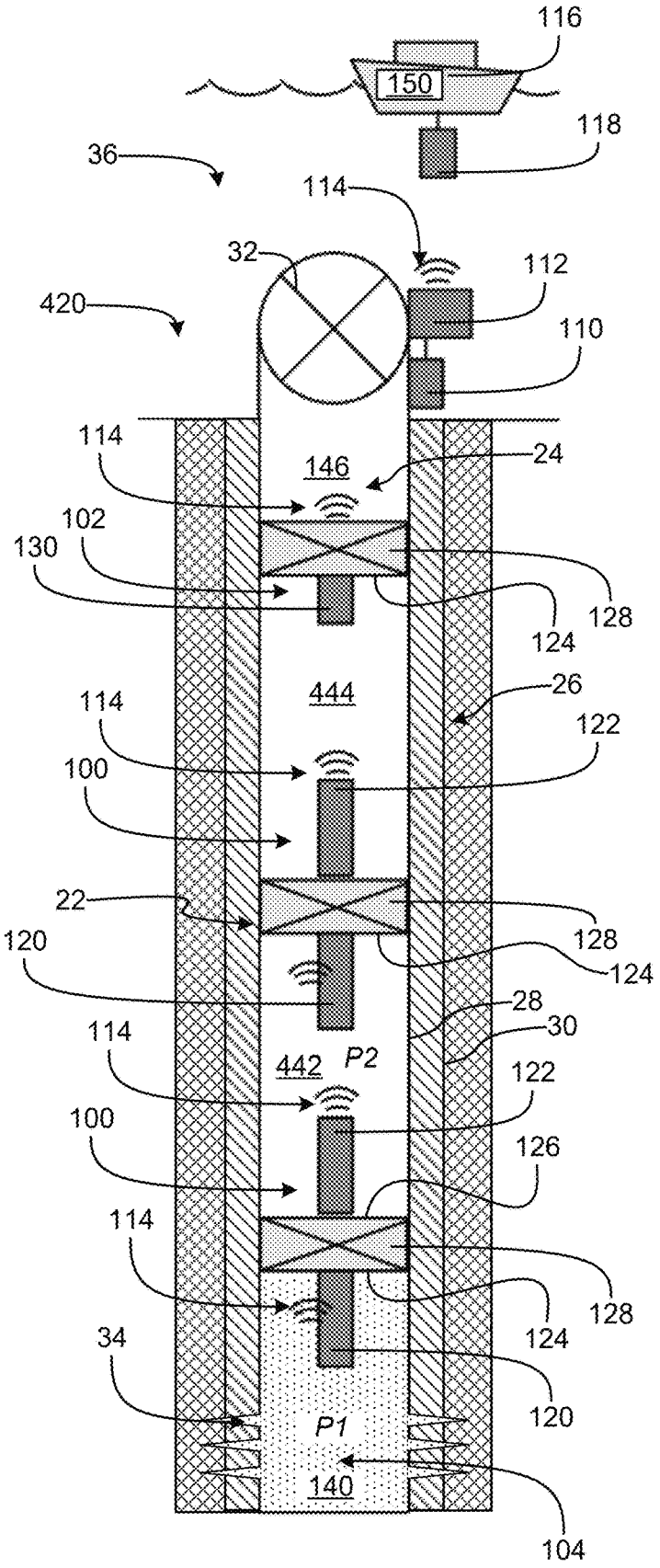
FIG. 4 is a cross-sectional view of a well system, according to an embodiment.

Referring to FIG. 4, to FIG. 1, a second example well system 420 is illustrated. The well system 420 includes the casing 22 may be disposed along the wellbore 24 drilled into the subterranean formation 26. In some instances, the well system 420 is located below water 36 (e.g., seawater). The well system 420 further includes a plurality of measurement plug assemblies 100 and one or more repeater plug assemblies 102 sealably engaged with the casing 22 and/or the wellbore 24. In operation, the measurement plug assemblies 100 and the repeater plug assemblies 102 seal the wellbore 24 to prevent pressurized hydrocarbons 104 (e.g., oil, gas, etc.) from traveling through the perforations 34 and upward through the casing 22.

Remaining with FIG. 4, the well system 420 further includes the first acoustic receiver 110 and the acoustic transponder 112, which, in some embodiments, are mounted to the wellhead 32. Further, in operation, the measurement plug assemblies 100, the repeater plug assemblies 102, the first acoustic receiver 110, and the acoustic transponder 112 work together to send acoustic signals 114 from the wellbore 24 through the water 36 to the boat 116 equipped with the second acoustic receiver 118.

Looking again at FIG. 4, one of the measurement plug assemblies 100, the casing 22, and the subterranean formation 26 define the primary chamber 140. Similarly, the measurement plug assemblies 100 and the casing 22 define one or more secondary chambers 442. Further, one of the measurement plug assemblies 100, the neighboring repeater plug assembly 102, and the casing 22 define an intermediate chamber 444. The wellhead 32 and one of repeat plug assemblies 102 define the terminal chamber 146.

With further reference to FIG. 4, in operation, one of the first gauge assemblies 120 measures the first pressure P1 of the hydrocarbons 104 trapped in the primary chamber 140. Similarly, in operation, one of the first gauge assemblies 120 and one of the second gauge assemblies 122 measure the second pressure P2 of fluid (e.g., air, seawater, etc.) trapped in the secondary chamber 442 by the eutectic plugs 128 of the measurement plug assemblies 100. Acoustic signals 114 from the first gauge assembly 120 travel through the eutectic plugs 128 of the measurement plug assemblies 100 and are received by the second gauge assembly 122 and/or the neighboring acoustic repeater 130. Similarly, acoustic signals 114 from the second gauge assembly 122 are received by the neighboring acoustic repeater 130. The acoustic repeater 130 successively receives and retransmits the acoustic signals 114 through the eutectic plugs 128 and up the wellbore 24 to the first acoustic receiver 110 and the acoustic transponder 112. The acoustic transponder 112 sends the acoustic signals 114 to the boat 116. On board the boat 116, the controller 150 determines the pressure differential between the first pressure P1 and the second pressure P2.

Figure 5:
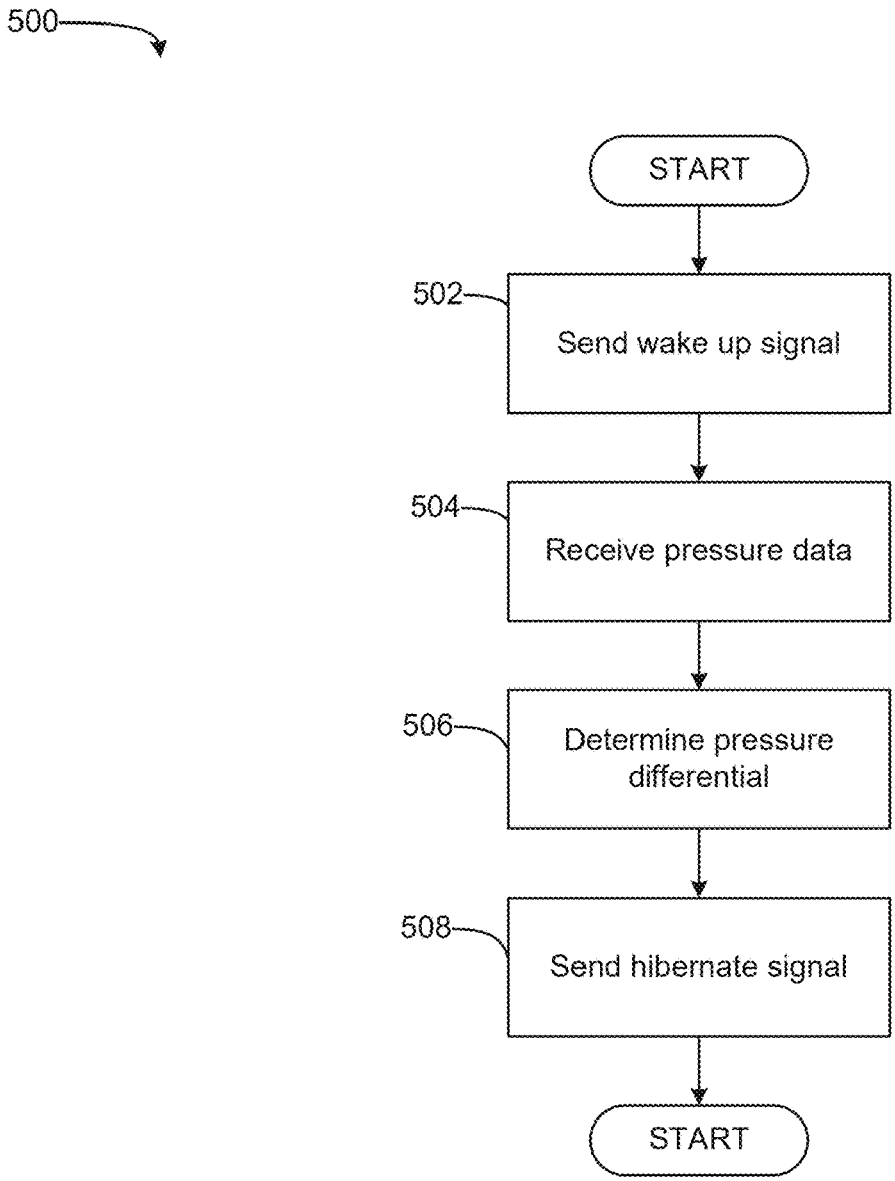
FIG. 5 is a flow diagram depicting a method to determine a pressure differential within the well system of FIG. 1, according to the principles of this disclosure.

FIG. 5 illustrates a flow diagram depicting a method 500 executable by the controller 150 of FIG. 1 to determine a pressure differential within the well system 20 of FIG. 1 and the well system 420 of FIG. 4. The method 500 starts at block 502, where the controller 150 sends a wake up signal. More specifically, the controller 150 transmits an acoustic sonar ping including the wake up signal to the acoustic transponder 112, which relays the wake up signal to the first gauge assembly 120 via the acoustic repeaters 130 and/or the second gauge assembly 122. The method 500 proceeds to block 504.

At block 504, the controller 150 receives pressure data. More specifically, the controller 150 receives one or more acoustic sonar pings including the pressure data from the acoustic transponder 112, which received the pressure data from the first gauge assembly 120 and the second gauge assembly 122 via the acoustic repeaters 130. The method 500 proceeds to block 506.

At block 506, the controller 150 determines a pressure differential. More specifically, the controller 150 compares the first pressure P1 to the second pressure P2. The method 500 proceeds to block 508.

At block 508, the controller 150 sends a hibernate signal. More specifically, the controller 150 transmits an acoustic sonar ping including the hibernate signal to the acoustic transponder 112, which relays the hibernate signal to the first gauge assembly 120, the second gauge assembly 122, and the acoustic repeaters 130. The first gauge assembly 120, the second gauge assembly 122, and the acoustic repeaters 130 enter a hibernation phase to conserve battery power. The method 500 then returns to block 502.

In other embodiments, other configurations are possible. For example, those of skill in the art will recognize, according to the principles and concepts disclosed herein, that various combinations, sub-combinations, and substitutions of the components discussed above can provide improved threaded connector assemblies.

The above description of the disclosed exemplary embodiments is provided to enable any person skilled in the art to make or use one or more aspects of the disclosure. Various modifications to these embodiments will be readily apparent to those skilled in the art, and the generic principles defined herein may be applied to other embodiments without departing from the spirit or scope of the disclosure. Thus, the disclosure is not intended to be limited to the embodiments shown herein but is to be accorded the widest scope consistent with the principles and novel features disclosed herein.

What is claimed is:

1. A wellbore seal comprising:

a eutectic plug configured to sealably engage a casing;

a first gauge assembly connected to a lower side of the eutectic plug, the first gauge assembly including, a pressure gauge configured to measure a pressure of a fluid, and an acoustic transceiver in communication with the pressure gauge and configured to transmit an acoustic signal based on the pressure through the eutectic plug; and a second gauge assembly positioned at an upper side of the eutectic plug, wherein the first gauge assembly and the second gauge assembly are acoustically and communicatively coupled with one another through the eutectic plug.

2. The wellbore seal of claim 1, wherein the eutectic plug is formed of a bismuth alloy.

3. The wellbore seal of claim 2, wherein the bismuth alloy includes tin.

4. The wellbore seal of claim 1, wherein the first gauge assembly includes a battery pack and an electronic module configured to manage power consumption of the battery pack.

5. The wellbore seal of claim 4, wherein the electronic module selectively enters into a hibernation phase to conserve battery power.

6. The wellbore seal of claim 1, wherein the first gauge assembly includes an electronic module configured to control the acoustic transceiver.

7. The wellbore seal of claim 6, wherein the electronic module generates electronic instructions based on pressure data from the pressure gauge.

8. The wellbore seal of claim 7, wherein the acoustic transceiver produces the acoustic signal based on the electronic instructions.

9. The wellbore seal of claim 1, wherein the first gauge assembly is connected to the lower side via an adaptor.

10. The wellbore seal of claim 1, wherein the second gauge assembly receives a command via one or more of an acoustic signal or a wireline cable.

11. The wellbore seal of claim 1, wherein the fluid is a first fluid, the pressure is a first pressure, and the second gauge assembly measures a second pressure of a second fluid.

12. The wellbore seal of claim 11, wherein the eutectic plug is configured to sealably isolate the first fluid from the second fluid.

13. The wellbore seal of claim 1, wherein the second gauge assembly is configured to be lowered to the eutectic plug via a wireline cable after the eutectic plug is installed.

14. A wellbore monitoring system comprising:

a casing;

a eutectic plug sealably engaged with the casing;

a first gauge assembly connected to a lower side of the eutectic plug, the first gauge assembly including a pressure gauge configured to measure a pressure of a fluid, and an acoustic transceiver in communication with the pressure gauge and configured to transmit an acoustic signal based on the pressure through the eutectic plug;

a second gauge assembly positioned at an upper side of the eutectic plug; and an acoustic transponder mounted to the casing and configured to relay the acoustic signal, such that the first gauge assembly and the second gauge assembly are acoustically and communicatively coupled with one another through the eutectic plug.

15. The wellbore monitoring system of claim 14, further comprising an acoustic repeater between the first gauge assembly and the acoustic transponder and configured to relay the acoustic signal between the first gauge assembly and the acoustic transponder.

* * * * *